US006000157A

United States Patent [19]

De Beurs et al.

[11] Patent Number: 6,000,157

[45] Date of Patent: Dec. 14, 1999

[54] IRON AND SOLEPLATE FOR AN IRON

[75] Inventors: Hans De Beurs, Drachten; Joseph G. Van Lierop; Ingrid J.M. Snijkers-Hendrickx, both of Eindhoven, all of Netherlands

[73] Assignee: U.S. Philips Corporation, New York, N.Y.

[21] Appl. No.: 08/933,595

[22] Filed: Sep. 19, 1997

[30] Foreign Application Priority Data

Sep. 24, 1996 [EP] European Pat. Off. ..... 96202673

[51] Int. Cl.[6] ..... D06F 75/38

[52] U.S. Cl. ..... 38/93

[58] Field of Search ..... 38/93, 74, 80, 38/81, 97; 219/245, 200, 228; 427/384, 397.7, 427, 450, 162

[56] References Cited

U.S. PATENT DOCUMENTS

| | | | |
|---|---|---|---|
| 4,197,335 | 4/1980 | Goosens | 427/162 |
| 4,665,637 | 5/1987 | Kramer | 38/93 |
| 4,822,686 | 4/1989 | Louison et al. | 38/93 |
| 4,862,609 | 9/1989 | Ullrich et al. | 38/93 |
| 5,025,578 | 6/1991 | Firatli et al. | 38/93 |
| 5,749,165 | 5/1998 | Schonborn et al. | 38/93 |

FOREIGN PATENT DOCUMENTS

| | | |
|---|---|---|
| 0206121A1 | 12/1986 | European Pat. Off. . |
| 0640714A1 | 3/1995 | European Pat. Off. . |
| 4410410A1 | 9/1995 | Germany . |

*Primary Examiner*—Ismael Izaguirre
*Attorney, Agent, or Firm*—Ernestine C. Bartlett

[57] ABSTRACT

The invention relates to an iron having a metal soleplate, which is provided with an anti-friction layer containing an inorganic polymer. To improve the scratch resistance of the anti-friction layer, a hard intermediate layer is provided between the predominantly aluminum part of the soleplate facing the anti-friction layer and the anti-friction layer.

This intermediate layer is preferably composed of aluminum oxide which is provided by means of an electrochemical treatment. The use of polymerized alkyl trialkoxysilane, in particular methyl trimethoxysilane, in the anti-friction layer makes it possible to obtain layers which are thicker and hence more scratch-resistant. In such layers, oxidic nano-particles and inorganic color pigments may be incorporated, which cause a further increase of the scratch resistance.

18 Claims, 1 Drawing Sheet

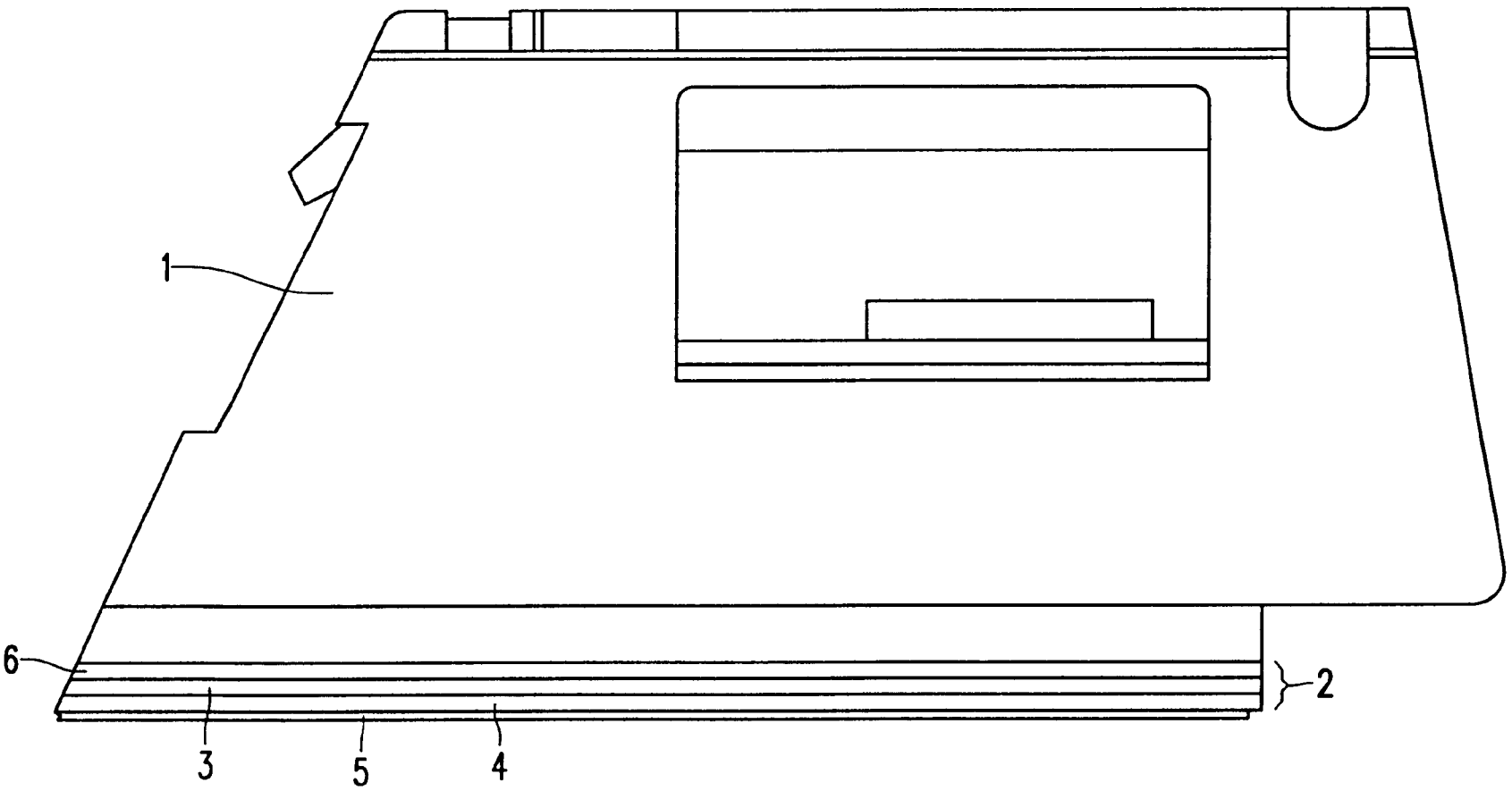
1
2
3
4
5
6

IRON AND SOLEPLATE FOR AN IRON

BACKGROUND OF THE INVENTION

The invention relates to an iron having a metal soleplate, which is provided with an anti-friction layer containing an inorganic polymer. The invention also relates to a soleplate having an anti-friction layer which is suitable for use in an iron.

An iron of the type mentioned in the opening paragraph is known per se, for example, from European Patent Application EP-640,714 and its equivalent U.S. Pat. No. 5,592,765, commonly assigned with this application. Said patent application (and U.S. patent) more specifically describes an iron which is provided with a stainless steel soleplate, which is coated with a thin anti-friction layer of polysilicate. This anti-friction layer can be applied from a solution by means of a sol-gel technique.

It has been found that, under certain conditions, the scratch resistance of the anti-friction layer of the known iron is sub-optimal. For example, if use is made of an aluminum soleplate, the scratch resistance of the anti-friction layer is not satisfactory. It has been found that fractures can develop in the anti-friction layer if the anti-friction layer of such an iron is moved over sharp objects and, simultaneously, a pressure is exerted on it.

SUMMARY OF THE INVENTION

It is an object of the invention to improve said known iron. The invention more particularly aims at providing an iron whose scratch resistance of the anti-friction layer is higher than that of the known iron. The invention also provides a soleplate having an improved scratch resistance.

These and other objects of the invention are achieved by an iron of the type mentioned in the opening paragraph, which is characterized in that the part of the soleplate which faces the anti-friction layer is predominantly made of aluminum, and a hard intermediate layer is provided between the soleplate and the anti-friction layer.

The invention is based on the experimentally gained insight that the unsatisfactory scratch resistance is caused by the fact that the underlayer is made of aluminum. Under certain conditions, this material proves to be too soft to cope with compressive loads which may occur during ironing. It has been found that this problem can be overcome by using a hard intermediate layer between the anti-friction layer and the soleplate.

In principle, the soleplate of the iron in accordance with the invention may consist of a single block of shaped aluminum. Alternatively, however, use can be made of soleplates which are composed of various parts. An example, which is interesting because it benefits the ease of manufacture, is a soleplate comprising a first part of die-castable aluminum to which a second part of substantially pure aluminum in the form of a thin plate is secured. It has been found that substantially pure aluminum is relatively soft. As a result, soleplates and soleplate parts of this material, on which the known anti-friction layer containing the three-dimensional inorganic polymer is provided, are extra sensitive to the formation of cracks in the anti-friction layer. Particularly in such a construction, the presence of a hard intermediate layer is an important advantage.

It is noted that a hard layer is to be understood to mean in this context a layer whose hardness is at least twice, and preferably at least five times that of aluminum. Such a hard layer can be obtained, for example, by treating the surface of the soleplate before the anti-friction layer is applied thereto. The aluminum surface can be hardened, for example, by a nitration or a carbonation process. In said process, diffusion of, respectively, nitrogen or carbon takes place in the aluminum layer which is situated at the surface of the soleplate.

Another solution, which is more interesting from the point of view of costs, is formed by the use of a thin, plate-shaped hard layer. Such a plate has to be secured to the surface of the aluminum(part), for example by beading, gluing together and/or by mechanical fastening means such as screws, rivets etc. In this respect, thin plates of hardened steel or of CrNi-steel proved to be very effective. These plates are provided with said ant-friction layer on one side, whereafter they are secured, with the uncoated surface, to the soleplate. The thickness of such plates is preferably chosen in the range between 0.2 and 4.0 mm.

A further interesting embodiment of the iron in accordance with the invention is characterized in that the hard intermediate layer consists of aluminum oxide. Such a hard intermediate layer can be obtained in a simple manner by electrochemically oxidizing the aluminum surface of the soleplate before the anti-friction layer is provided. Suitable ways of providing the oxide layer are commonly referred to as "(hard) anodizing", "eloxing" and "opalescing". Further experiments have revealed that the anti-friction layer containing the inorganic polymer bonds very well to such an intermediate layer of aluminum oxide.

The thickness of the intermediate layer preferably ranges between 5 micrometers and 60 micrometers. If the thickness of the intermediate layer is 5 micrometers or less, then the scratch-resistance of the anti-friction layer is insufficiently improved. Hard intermediate layers having a thickness of 60 micrometers or more are unattractive from the point of view of the costs. An optimum compromise between both disadvantages is achieved by intermediate layers having a thickness in the range between 10 and 40 micrometers.

The inorganic polymer of the anti-friction layer is preferably provided on the hard layer by means of a sol-gel process. In this process, a three-dimensional, inorganic polymer is formed. If necessary, this polymer may also comprise organic side groups. Suitable anti-friction layers contain polymers based on Zr-oxide, Al-oxide, Ti-oxide and, preferably, Si-oxide, or mixtures thereof.

When use is made of a sol-gel solution for the manufacture of layers on a substrate, first of all, a colloidal suspension of solid particles in a liquid is prepared. In the present case, said colloidal suspension preferably consists of hydrolyzed metal-alkoxide particles in an organic solvent. In this connection, known metal alkoxides are Ti-, Zr-, Al- and Si-tetraalkoxides. Usually an alcohol is used as the organic solvent. Said colloidal solution is formed by adding a defined quantity of water as well as a small quantity of an acid or base as the catalyst to the metal-oxide(mixture). The resultant colloidal solution which is stabilized in alcohol can subsequently be provided, in the form of a thin layer, on a desired substrate. The catalyst and the water added bring about (partial) hydrolysis of the alkoxides. As a result, polycondensation takes place, so that an inorganic polymer is formed. This process is accelerated at a higher temperature. The solvents of the resultant sol-gel layer largely evaporate during the provision process. The residual solvents are evaporated at a higher temperature.

By means of the sol-gel process, very thin layers of a three-dimensional, inorganic polymer can be formed on the hard intermediate layer of the aluminum soleplate. If use is made of said metal-tetraalkoxides, the thickness of said layers is approximately 0.5 micrometer or less. The use of thin layers on the basis of a three-dimensional, inorganic polymer with metal alkoxides as the precursor ensure that the inventive anti-friction layers are very cheap. It is noted that three-dimensional inorganic polymers exhibit a greater hardness and resistance to fracture than linear inorganic polymers. Therefore, three-dimensional polymers are preferred.

There are various ways of providing the colloidal solution on the soleplate in the form of a layer, for example by dip-coating or spinning. Preferably, the layer is provided by means of spraying techniques. Layers provided in this manner have a lower coefficient of friction than layers provided by spin-coating. If thicker layers are required, the application process is repeated a number of times.

A preferred embodiment of the iron in accordance with the invention is characterized according to the invention in that the three-dimensional, inorganic polymer is predominantly composed of polymerized alkyltrialkoxysilane. It has been found that anti-friction layers based on this type of polymerized silane exhibit a substantially higher resistance to fracture than anti-friction layers based on tetraalkoxysilanes as disclosed in the above-mentioned Patent publication. Consequently, the layer thicknesses of the anti-friction layer of the iron in accordance with this embodiment of the invention can be much thicker than the layer thicknesses of the anti-friction layer of the iron in accordance with the prior art. The use of a relatively thick anti-friction layer contributes to an increase of the resistance to wear of the layer. The anti-friction layer of the iron in accordance with the invention can be made in a thickness ranging from 10 to 25 micrometers. To optimize the serviceability, the layer thickness of the known anti-friction layer should in practice be less than 20 micrometers. It has been found that undesirable crack-formation in the anti-friction layer may occur at larger thicknesses. The optimum thickness of this type of anti-friction layer ranges between 5 and 15 micrometers.

It has been found that, in particular, the lower alkyl groups, such as phenyl-, propyl- and ethyl-trialkoxysilane can be used very advantageously in this type of anti-friction layer. The best results were achieved with methyltrialkoxysilane. The layers obtained with methyltrialkoxysilane exhibit a better resistance to high temperatures than the layers manufactured from silanes comprising higher and/or more complex alkyl groups.

It has further been found that the anti-friction layer advantageously contains a quantity of a filler, such as oxidic nano-particles. These oxidic particles have an average particle size below 100 nm. Suitable examples hereof are nano-particles of $ZrO_2$, $Al_2O_3$, $TiO_2$ and/or $SiO_2$. The quantity of said particles preferably ranges from 30 to 70 wt. %, calculated with respect to the overall weight of the anti-friction layer. Good results were achieved by using approximately 50 wt. % of nano-particles as a filler in the anti-friction layer. The presence of these fillers leads to an increase of the hardness of the anti-friction layer.

Another interesting embodiment of the iron in accordance with the invention is characterized according to the invention in that the anti-friction layer contains inorganic color pigments as the filler. These color pigments also provide the anti-friction layer with a greater hardness. In addition, the "appearance" of the anti-friction layer is improved by the presence of such color pigments. In particular, inorganic color pigments on the basis of (mixed) metal oxides prove to be satisfactory. A few very suitable types of color pigments are $Fe_2O_3$, $CoAl_2O_4$, as well as mixed metal oxides on the basis of TiNiSb and TiCrSb. These color pigments have an average particle size of several tenths of a micrometer. Consequently, they are suitable, in particular, for use in thicker anti-friction layers, such as anti-friction layers which can be manufactured by means of alkyltrialkoxysilane.

The invention also relates to loose soleplates which are provided with an anti-friction layer and which are suitable for use in an iron. In accordance with the invention, the part of the inventive soleplate facing the anti-friction layer is predominantly composed of aluminum, and a hard intermediate layer is provided between the soleplate and the anti-friction layer of inorganic polymer. It is noted that the invention can be used both in conventional irons and in steam irons.

These and other aspects of the invention will be apparent from and elucidated with reference to the embodiments described hereinafter.

BRIEF DESCRIPTION OF THE DRAWINGS

In the drawing:

FIG. 1 shows an iron in accordance with the invention.

It is noted that, for clarity, the iron shown in FIG. 1, in particular the thickness of the various layers, is not drawn to scale.

DESCRIPTION OF THE PREFERRED EMBODIMENTS

FIG. 1 is a schematic side view of a preferred embodiment of a steam iron in accordance with the invention. Said iron comprises a synthetic resin housing (1) whose bottom side is provided with a metal soleplate (2). In this case, the soleplate is made of a block (6) of die-castable aluminum to which a thin plate (3) of pure aluminum is secured. The surface of the soleplate facing away from the housing is provided, in succession, with a hard intermediate layer (4) and an anti-friction layer (5). The hard intermediate layer (4) consists, for example, of a separately provided plate of NiCr-steel or, preferably, of a thin layer of electrochemically provided aluminum oxide. The anti-friction layer (5) contains a three-dimensional inorganic polymer which is provided by means of a sol-gel process. Hereinbelow, a description will be given of a number of embodiments of irons.

In a first embodiment in accordance with the prior art, the soleplate of the iron comprises a solid, die-cast block of Si-containing aluminum. This is subsequently provided, by means of a sol-gel technique, with a 0.3 micrometer thick layer of polysilicate, as described in the above-mentioned Patent Specification EP-640,714. This iron is designated "type A".

In a first embodiment in accordance with the invention, the soleplate of the iron comprises a solid, die-cast block of Si-containing aluminum. A hard layer in the form of a thin plate (0.4 mm thick) of NiCr-steel is secured thereto. For this purpose, a main surface of the plate and said block were glued together and the edge of the plate was beaded. On the surface facing away from the iron, this plate had already been provided with a thin anti-friction layer. This layer was composed of a 0.4 micrometer thick layer of polysilicate. This layer was provided as described in the above-mentioned Patent Specification. This iron is designated "type B".

In a second embodiment in accordance with the invention, the soleplate of the iron comprises a solid, die-cast block of Si-containing aluminum. A thin plate (1.6 mm thick) of pure aluminum was provided thereon by means of screwed and glued joints. The surface of this plate facing away from the block had been previously provided with, in succession, a hard layer and an anti-friction layer of a three-dimensional inorganic polymer. The hard layer consisted of a 23 micrometer thick layer of aluminum oxide which was provided by means of electrochemical deposition, (hard anodizing). The anti-friction layer consisted of a 0.6 micrometer thick layer of polysilicate. This layer was provided as described in the above-mentioned Patent Specification. This iron is designated "type C".

In a third embodiment in accordance with the invention, the iron comprises a soleplate which is substantially identical to the one of the second embodiment. In the third embodiment, however, the thickness of the hard layer was 35 micrometers. In the third embodiment, the anti-friction layer had a thickness of 10 micrometers and contained a three-dimensional inorganic polymer which was organically modified. To increase the hardness of the anti-friction layer, this layer also contained a quantity of oxidic nano-particles as well as a relatively small quantity of inorganic color pigment. This iron is designated "type D".

The anti-friction layer of the "type D" iron was manufactured as follows. First, a sol-gel solution containing 19.4 g MTMS (methyltrimethoxysilane), 0.9 g TEOS (tetraethylorthosilicate), 2.7 g HAc (acetic acid), 20 g oxidic nano-particles (silicasol having a solids content of 50%; ludox) and 1 g inorganic color pigment was prepared. After hydrolyzing for one hour, the solution was sprayed onto the ironing surface of a soleplate of anodized aluminum by means of a spraying robot. The sol-gel layer thus provided was cured at 300° C. for 45 minutes. The resultant anti-friction layer predominantly contained a three-dimensional inorganic polymer of organically modified polysilicate (thickness 10 micrometers). Depending on the type of inorganic pigment, the anti-friction layer could be manufactured in different colors. The layer exhibited a good scratch-resistance and a good adhesion to the metal soleplate. Deterioration of the adhesion after the soleplate had been exposed 500 times to a temperature cycle from 20–300° C. did not take place.

From a comparison of the four types of irons, the following conclusion could be drawn. In all cases, the use of a hard intermediate layer leads to an increase of the scratch resistance of the anti-friction layer. For reasons relating to the ease of manufacture, the use of a hard layer formed by an electrochemically treated layer of aluminum oxide has clear advantages. The adhesion of an anti-friction layer on the basis of a three-dimensional inorganic polymer to such a layer is better than to a plate, for example, of NiCr steel. The important advantage of the use of organically modified trialkoxysilanes is that they enable thicker anti-friction layers to be manufactured. In addition, oxidic nano-particles causing a further increase of the hardness of the anti-friction layer can be incorporated in this type of layers. An additional advantage is that, for this purpose, also inorganic color pigments can be incorporated in this type of thick anti-friction layers. Moreover, these color pigments provide the layer with an attractive appearance.

We claim:

1. An iron having a metal soleplate, which is provided with an anti-friction layer containing an inorganic polymer, wherein a portion of the soleplate which faces the anti-friction layer is predominantly made of aluminum, and a hard intermediate layer is provided between said portion of the soleplate and the anti-friction layer.

2. An iron as claimed in claim 1, wherein the hard intermediate layer consists of aluminum oxide.

3. An iron as claimed in claim 1, wherein the thickness of the hard intermediate layer ranges between 5 micrometers and 60 micrometers.

4. An iron as claimed in claim 1, wherein the inorganic polymer of said anti-friction layer is provided by means of a sol-gel process.

5. An iron as claimed in claim 4, wherein the inorganic polymer is predominantly composed of polymerized alkyltrialkoxysilane.

6. An iron as claimed in claim 4, wherein the inorganic polymer is predominantly composed of methyltrialkoxysilane.

7. An iron as claimed in claim 1, wherein the anti-friction layer contains oxidic nano-particles.

8. An iron as claimed in claim 1, wherein the anti-friction layer also contains inorganic color pigments.

9. A soleplate which is suitable for use in an iron and which comprises an anti-friction layer containing an inorganic polymer, wherein a surface of the soleplate which faces the anti-friction layer is predominantly made of aluminum, and a hard intermediate layer is provided between said surface and the anti-friction layer.

10. A soleplate as claimed in claim 9, wherein the hard intermediate layer consists of aluminum oxide.

11. A soleplate as claimed in claim 9, wherein the thickness of the intermediate layer ranges between 5 micrometers and 60 micrometers.

12. A soleplate as claimed in claim 9, wherein the inorganic polymer is predominantly composed of polymerized alkyltrialkoxysilane.

13. A soleplate as claimed in claim 9, wherein the anti-friction layer contains oxidic nano-particles.

14. A soleplate as claimed in claim 9, wherein the anti-friction layer also contains inorganic color pigments.

15. A soleplate which is suitable for use in an iron and which comprises a die-castable aluminum to which a plate of aluminum is secured, the outer surface of the soleplate being provided with a plate of NiCr-steel having on its surface an anti-friction layer of a three-dimensional inorganic polymer provided thereon by a sol-gel process.

16. A soleplate as claimed in claim 15, wherein the thickness of the NiCr-steel is 35 micrometers, the anti-friction layer has a thickness of 10 micrometers and the inorganic polymer is methyltrialkoxysilane.

17. A soleplate which is suitable for use in an iron and which comprises a die-castable aluminum to which a plate of aluminum is secured, the outer surface of the soleplate being provided with a layer of aluminum oxide having on its surface an anti-friction layer of a three-dimensional inorganic polymer provided thereon by a sol-gel process.

18. A soleplate as claimed in claim 17, wherein the aluminum oxide is electrochemically provided to have a thickness of 35 micrometers, the anti-friction layer has a thickness of 10 micrometers and the inorganic polymer is methyltrialkoxysilane.

* * * * *